US005079119A

United States Patent [19]

Suzuki et al.

[11] Patent Number: 5,079,119

[45] Date of Patent: Jan. 7, 1992

[54] PHOTORECEPTOR

[75] Inventors: Shinichi Suzuki; Hirofumi Hayata; Osamu Sasaki, all of Hachioji, Japan

[73] Assignee: Konica Corporation, Tokyo, Japan

[21] Appl. No.: 483,217

[22] Filed: Feb. 22, 1990

[30] Foreign Application Priority Data

Feb. 23, 1989 [JP] Japan ..... 1-44160

[51] Int. Cl.[5] ..... G03G 15/02; G03G 15/00; G03G 15/06

[52] U.S. Cl. ..... 430/59; 430/70; 430/73

[58] Field of Search ..... 430/59, 70, 73

[56] References Cited

U.S. PATENT DOCUMENTS

| | | | |
|---|---|---|---|
| 3,189,447 | 6/1965 | Neugebauer et al. | 96/1 |
| 3,274,000 | 9/1966 | Noe et al. | 96/1.5 |
| 3,820,989 | 6/1974 | Rule et al. | 96/1.5 |

FOREIGN PATENT DOCUMENTS

| | | |
|---|---|---|
| 47-36428 | 9/1972 | Japan . |
| 58-65440 | 4/1983 | Japan . |
| 58-198043 | 11/1983 | Japan . |
| 63-189872 | 8/1988 | Japan . |
| 63-198068 | 8/1988 | Japan . |
| 64-25748 | 1/1989 | Japan . |

*Primary Examiner*—Marion E. McCamish
*Assistant Examiner*—S. Crossan
*Attorney, Agent, or Firm*—Finnegan, Henderson, Farabow, Garrett, and Dunner

[57] ABSTRACT

A photoreceptor having at least a light-sensitive layer, which photoreceptor contains a compound represented by the following general formula (1):

(I)

where $Ar^1$, $Ar^2$ and $Ar^3$ each represents a substituted or unsubstituted alkyl group,a substituted or unsubstituted aryl group or a substituted or unsubstituted heterocyclic group, provided that $Ar^1$ and $Ar^2$ may form a ring together with the nitrogen atom to which they are bound; $R^1$, $R^2$, $R^3$ and $R^4$ each represents a hydrogen atom, a halogen atom, an alkoxy group, or a substituted or unsubstituted alkyl group.

12 Claims, 1 Drawing Sheet

PHOTORECEPTOR

BACKGROUND OF THE INVENTION

This invention relates to a photoreceptor, particularly to an electrophotographic photoreceptor.

Photoreceptors having light-sensitive layers chiefly composed of organic photoconductive compounds have many advantages such as relative ease in manufacture, low cost and easy handling. Further, they are usually more heat-resistant than photoreceptors using inorganic selenium as a photoconductive material. Among various organic photoconductive compounds used today, poly-N-vinylcarbazole is best known and photoreceptors having light-sensitive layers chiefly composed of charge transfer complexes formed of this compound and Lewis acids such as 2,4,7-trinitro-9-fluorenone are already in commercial use.

A proposal has also been made that different materials be used to fulfill the two principal functions of photoconductors, i.e., carrier generation and carrier transport, and photoreceptors of such a "functionally separated" type are known to incorporate carrier generation and transport materials either in superposed layers or in a single layer. As an extension of this approach, a photoreceptor having a light-sensitive layer composed of a carrier generation layer in the form of a thin amorphous selenium layer and a carrier transport layer containing poly-N-vinylcarbazole as a chief component is already in commercial use.

However, poly-N-vinylcarbazole is inflexible and its film is so rigid and brittle that it will easily crack or separate from the substrate. Thus, photoreceptors using this compound as a photoconductive material do not have high endurance. If one attempts to solve this problem by adding plasticizers, high residual potential will develop in electrophotographic processing and during cyclic use, the residual potential builds up to cause increased fogging until the copy image is substantially impaired.

Low-molecular weight organic photoconductive compounds usually do not have a film forming ability and hence are used in combination with suitable binders. This practice is preferred in that the physical properties or sensitivity characteristics of the photoconductive film can be controlled to some extent by properly selecting such factors as the type of binder used and its compositional ratio. However, the types of organic photoconductive compounds that are highly miscible with binders are limited and there are not many binders available that can be used to construct light-sensitive layers in photoreceptors, particularly in electrophotographic photoreceptors. For example, the 2,5-bis(p-diethylaminophenyl)-1,3,4-oxadiazole described in U.S. Pat. No. 3,189,447 have only low miscibility with binders such as polyesters and polycarbonates that are commonly used in the light-sensitive layers of electrophotographic photoreceptors. If this compound is used in the amount necessary to provide desired electrophotographic characteristics, oxadiazole will start to crystallize at 50° C. and above to impair the electrophotographic characteristics such as charge retention and sensitivity.

On the other hand, the diarylalkane derivatives described in U.S. Pat. No. 3,820,989 are comparatively satisfactory in terms of miscibility with binders. However, they are not highly lightfast and if they are used in the light-sensitive layer of a photoreceptor that is to be applied to cyclic transfer electrophotography where charging and exposure are repeatedly performed, the sensitivity of the photoreceptor will gradually deteriorate.

U.S. Pat. No. 3,274,000 and JP-B-47-36428 (the term "JP-B" as used herein means an "examined Japanese patent publication") describe different types of phenothiazine derivatives but each of them has low sensitivity to light and its performance will deteriorate during cyclic use.

The stilbene compounds described in JP-A-58-65440 and JP-A-58-198043 (the term "JP-A" as used herein means an "unexamined published Japanese patent application") are comparatively satisfactory in terms of charge retention and sensitivity but their endurance is not so good as to withstand cyclic use. The bisstilbene compounds described in JP-A-63-189872 and JP-A-64-25748 do not have high solubility and their miscibility with binders is low.

Thus, none of the carrier transport materials discovered to date have characteristics that should be satisfied in order to fabricate practically acceptable electrophotographic photoreceptors.

SUMMARY OF THE INVENTION

An object, therefore, of the present invention is to provide a photoreceptor that has high sensitivity, that produces low residual potential, that will experience less deterioration due to fatigue during cyclic use, and that has sufficient endurance to exhibit consistent characteristics for a prolonged period.

This object of the present invention can be attained by a photoreceptor containing a compound represented by the following general formula (I):

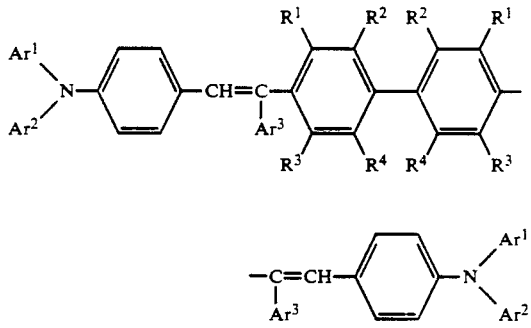

(I)

where $Ar^1$, $Ar^2$ and $Ar^3$ each represents a substituted or unsubstituted alkyl group, a substituted or unsubstituted aryl group or a substituted or unsubstituted heterocyclic group, provided that $Ar^1$ and $Ar^2$ may form a ring together with the nitrogen atom to which they are bound; $R^1$, $R^2$, $R^3$ and $R^4$ each represents a hydrogen atom, a halogen atom, an alkoxy group, or a substituted or unsubstituted alkyl group.

DETAILED DESCRIPTION OF THE INVENTION

Figure 1:
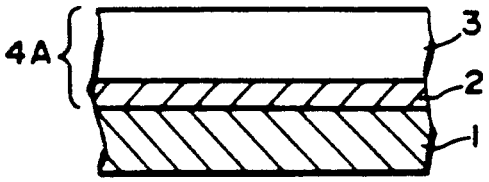
FIGS. 1 to 6 are partially enlarged sectional views of electrophotographic photoreceptors having different layer arrangements.
Figure 2:
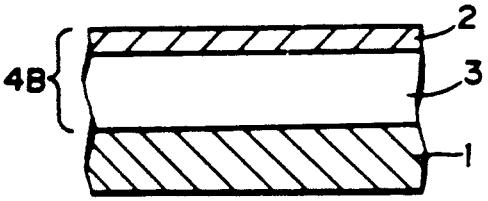

The most characteristic feature of the present invention lies in using the novel carrier transport material represented by the general formula (I) set forth herein-above. While the advent of photoconductive materials and carrier transport materials having new and satisfactory characteristics has long been desired, the organic compounds available today that have a so-called "conjugate system" in their molecular structure are almost infinite in number and manufacturers of photoreceptors have to determine promising compounds from a vast number of molecular structures on an trial-and-error basis.

Under these circumstances, the present inventor produced new compounds having the structure represented by the general formula (I) and found that they had the following desired characteristics when used as carrier transport materials. First, the compounds represented by the general formula (I) are highly susceptible to charge injection, have high charge transport ability, are chemically stable and have high resistance to light and electrical load. A photoreceptor incorporating such compounds has high sensitivity and its performance remains stable during cyclic use. Second, these compounds are highly miscible with various high-molecular weight binders and neither turbidity nor opacity will occur even if they are used in increased amounts relative to high-molecular weight binders. This provides a very broad range over which those compounds can be mixed with high-molecular weight binders, thus contributing to the fabrication of photoreceptors having preferred carrier transport ability and characteristics. Third, the high miscibility of these compounds with high-molecular weight binders helps form a uniform and stable carrier transport layer and this results in the fabrication of a photoreceptor that has satisfactory sensitivity and charging characteristics, that is free from fogging, and that is capable of producing a highly sensitive and sharp image. Fourthly, the so fabricated photoreceptor will not experience deterioration due to fatigue during cyclic use. Fifthly, the compounds of the general formula (I) are safe to use, environment friendly and chemically stable.

The compounds represented by the general formula (I) are described below in greater detail. Examples of the alkyl group represented by each of $Ar^1$, $Ar^2$ and $Ar^3$ included methyl, ethyl, propyl and butyl. Examples of the aryl group represented by $Ar^1$, $Ar^2$ and $Ar^3$ include phenyl and naphthyl. Examples of the heterocyclic group represented by $Ar^1$, $Ar^2$ and $Ar^3$ include furyl, thienyl and quinolyl. Substituted alkyl groups include aralkyl groups such as benzyl and phenethyl. The alkyl, aryl and heterocyclic groups represented by $Ar^1$, $Ar^2$ and $Ar^3$ may have substituents such as alkyl groups (e.g. methyl, ethyl, propyl and butyl), alkoxy groups (e.g. methoxy, ethoxy and propoxy), halogen atoms (i.e., fluorine, chlorine, bromine and iodine), and dialkylamine groups such as dimethylamino and diethylamino. Examples of the alkyl group represented by each of $R^1$, $R^2$, $R^3$ and $R^4$ include methyl, ethyl, propyl, butyl, etc.; examples of the alkoxy group represented by $R^1$, $R^2$, $R^3$ and $R^4$ include methoxy, ethoxy, propoxy, etc; and examples of the halogen atom reprocented by $R^1$, $R^2$, $R^3$ and $R^4$ include fluorine, chlorine, bromine and iodine.

The following are specific but non-limiting examples of the compounds represented by the general formula (I):

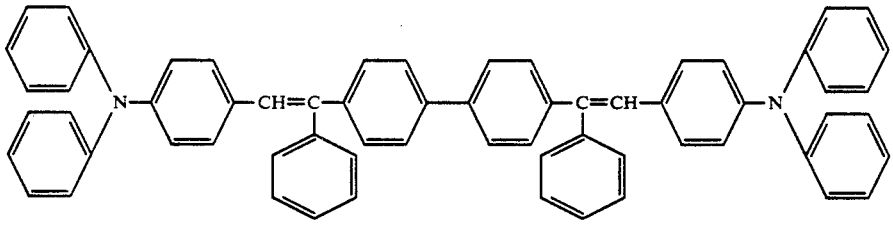

(1)

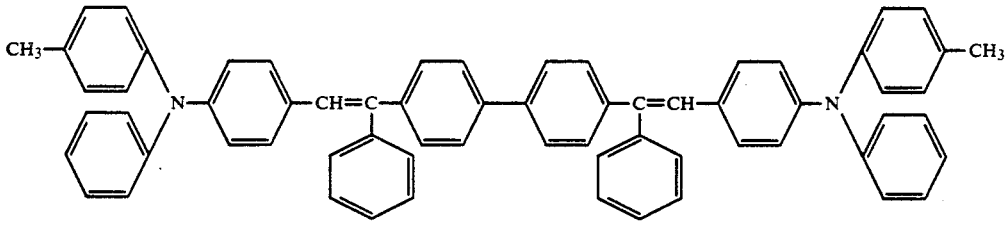

(2)

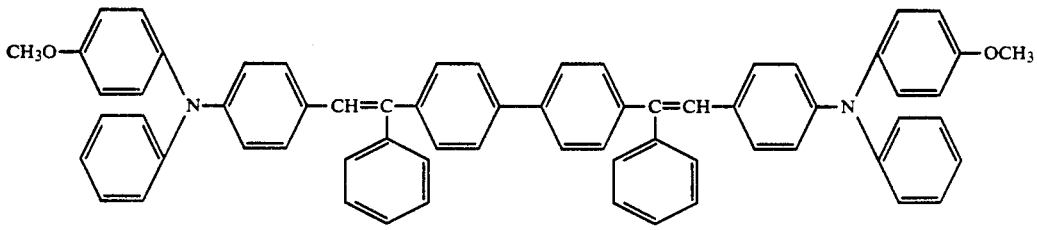

(3)

-continued
(4)
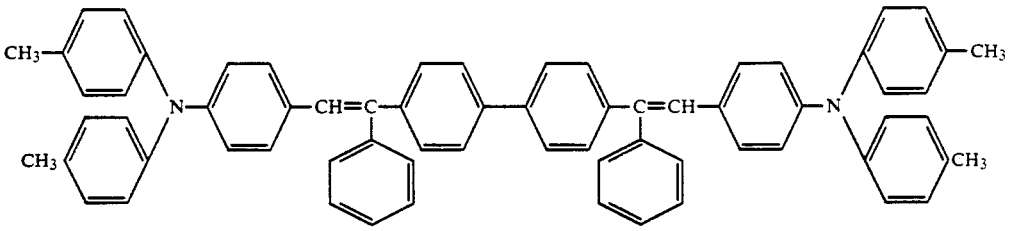
(5)
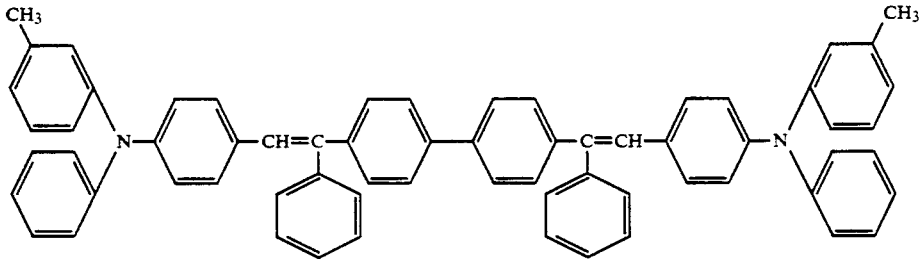
(6)
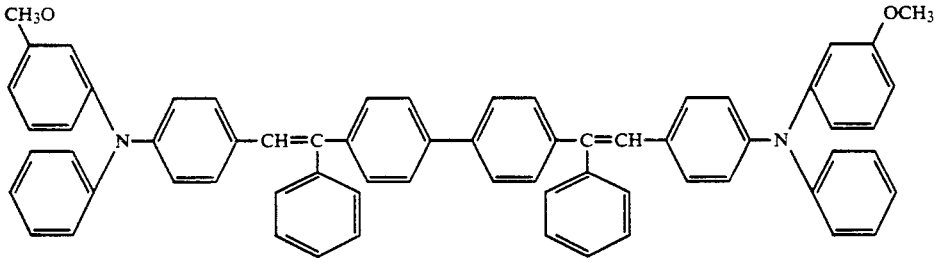
(7)
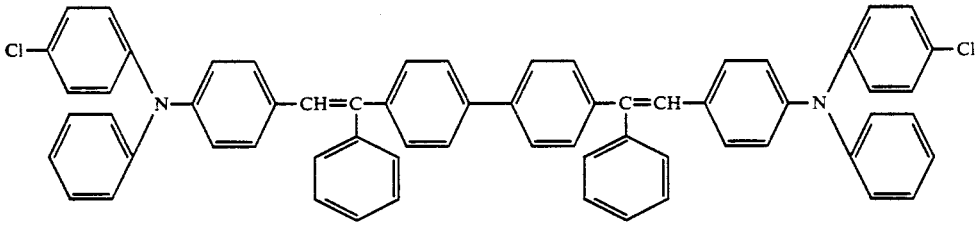
(8)
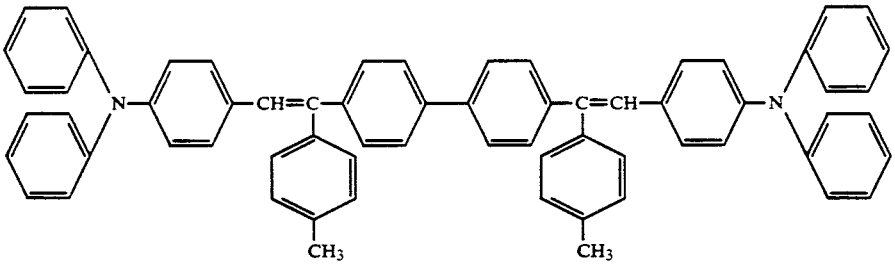
(9)
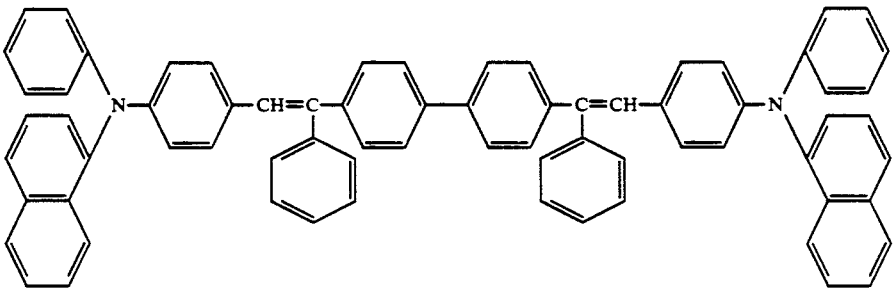

-continued
(10)
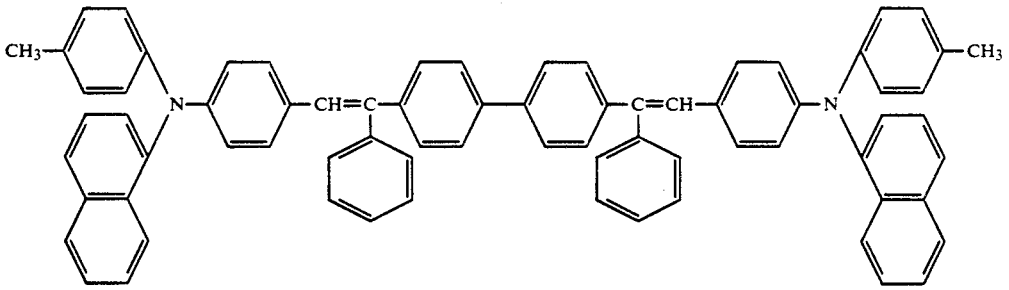
(11)
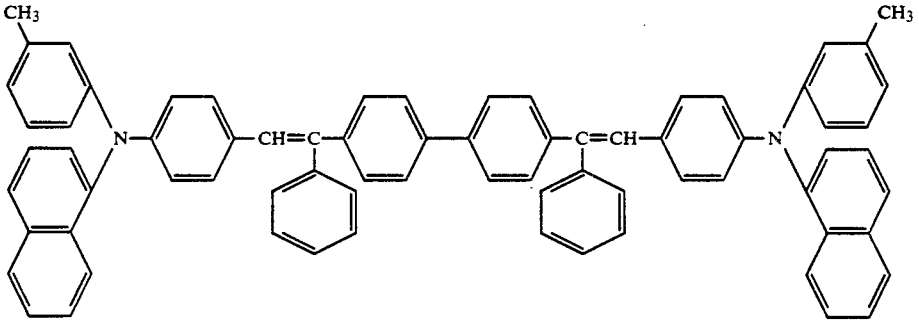
(12)
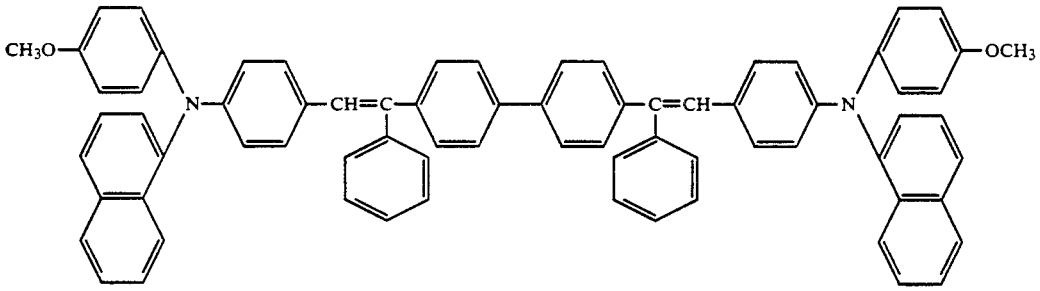
(13)
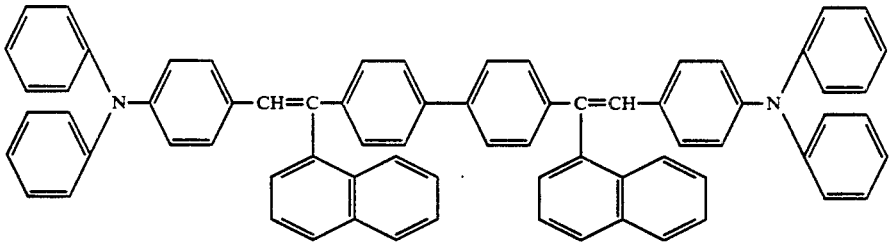
(14)
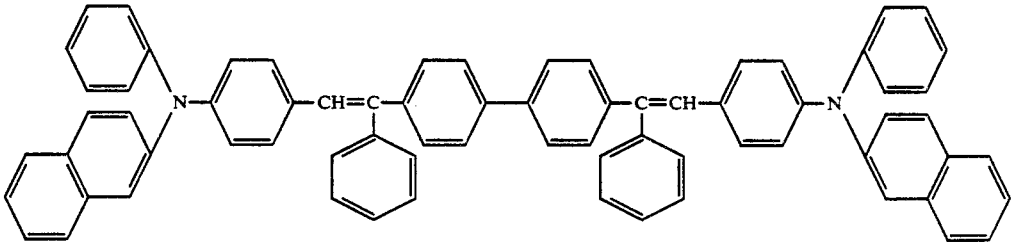

-continued
(15)
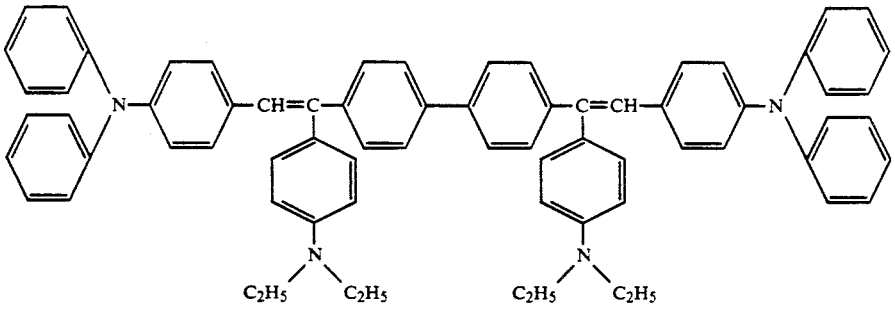
(16)
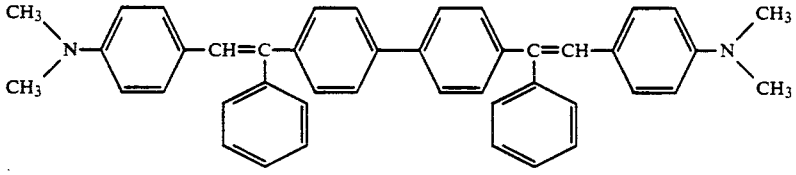
(17)
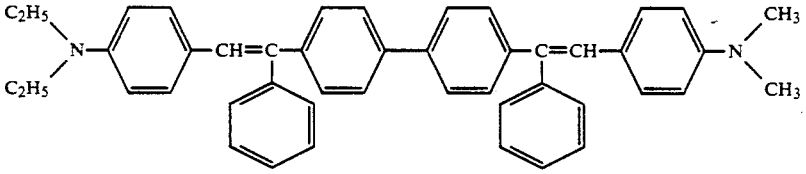
(18)
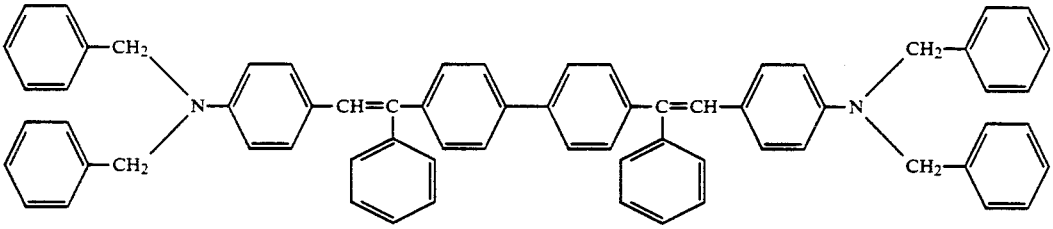
(19)
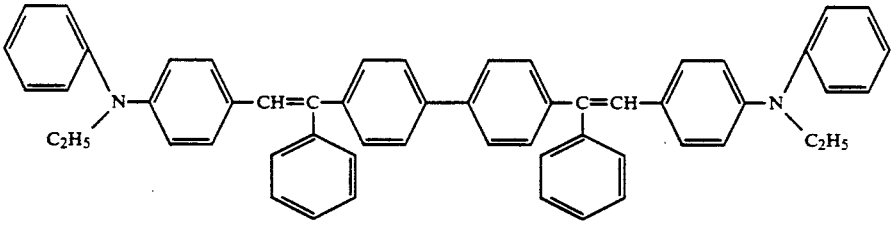
(20)
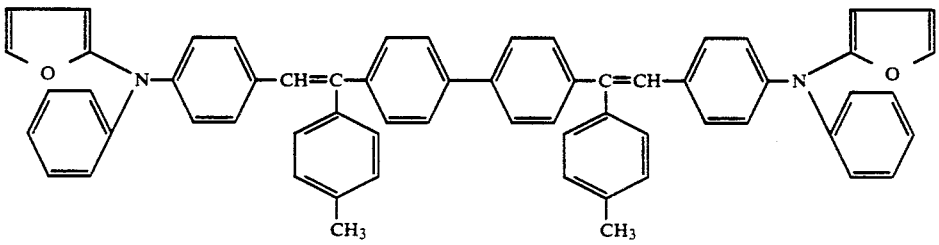

-continued
(21)
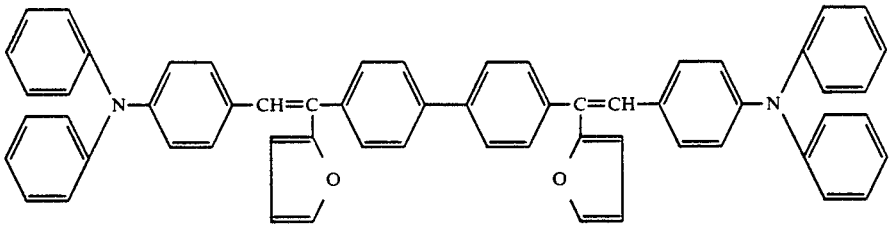
(22)
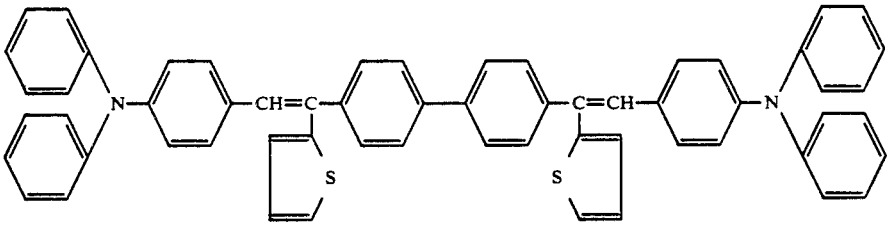
(23)
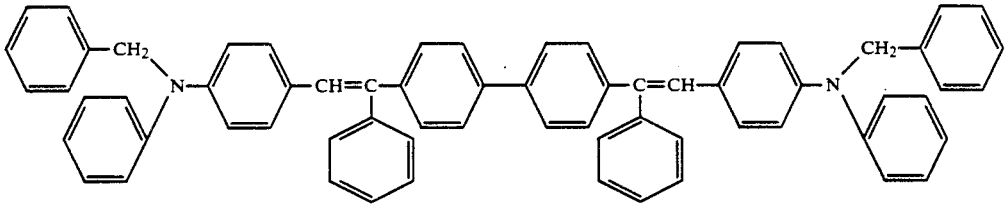
(24)
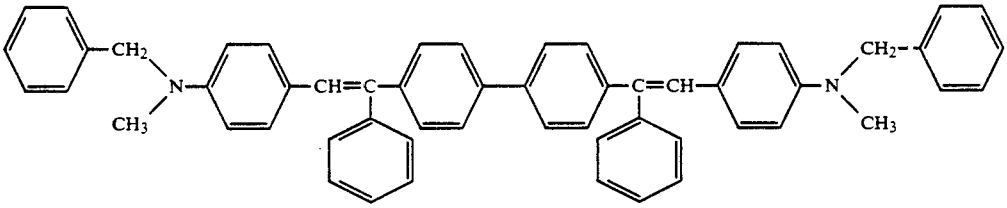
(25)
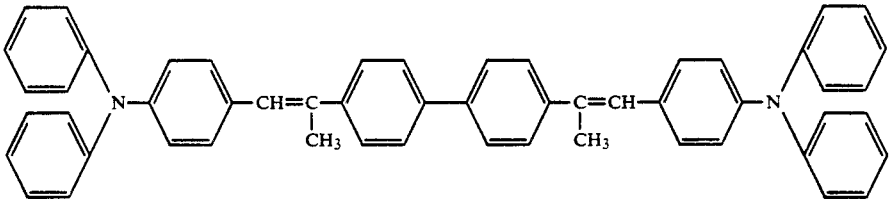
(26)
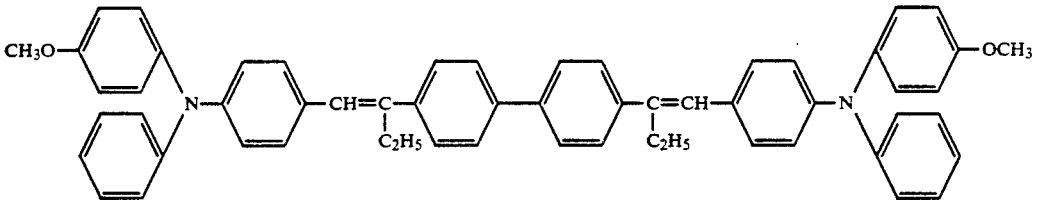
(27)
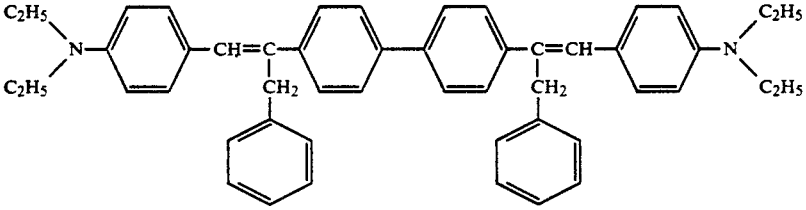

-continued
(28)
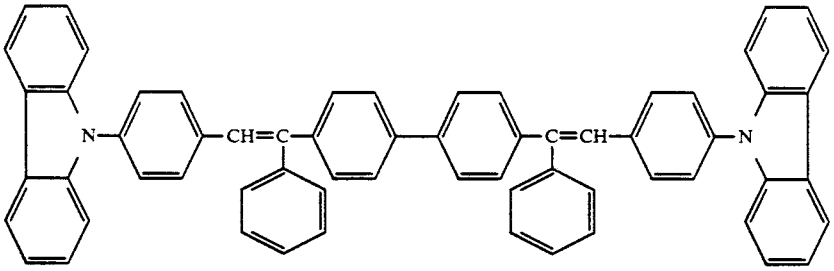
(29)
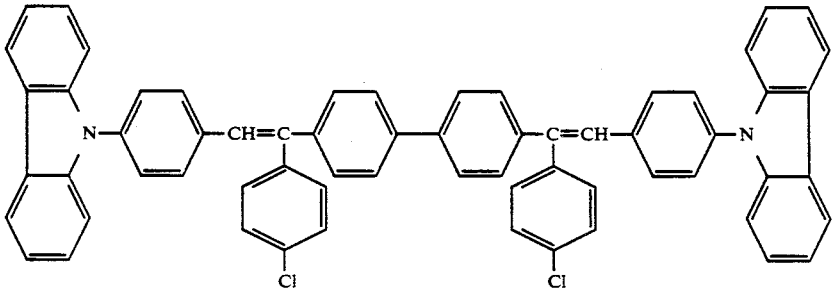
(30)
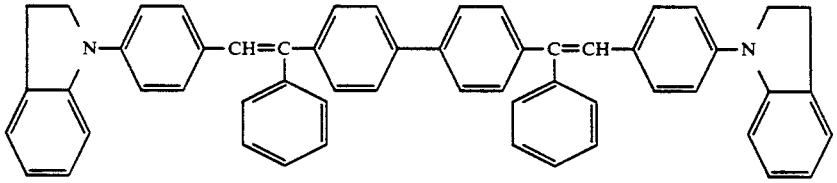
(31)
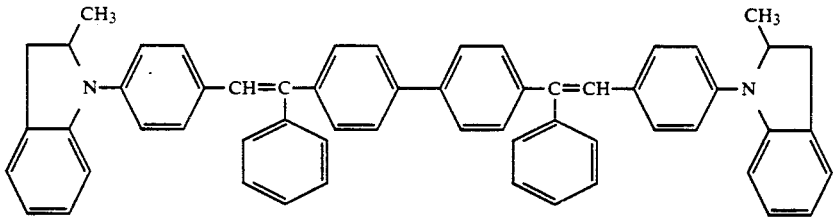
(32)
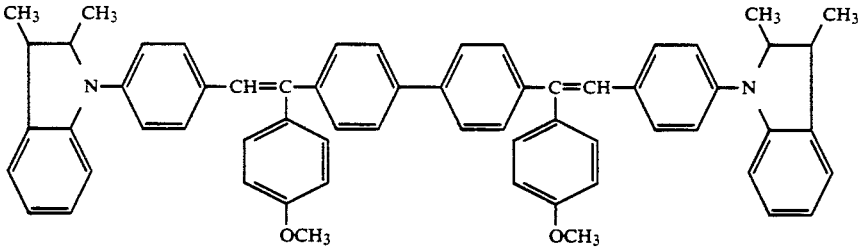
(33)
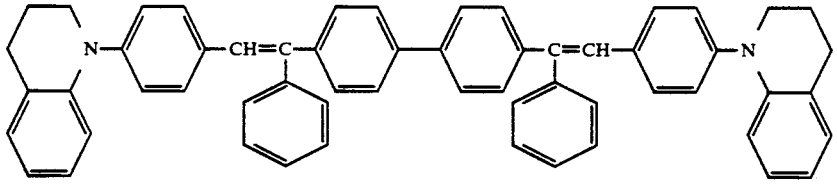
(34)
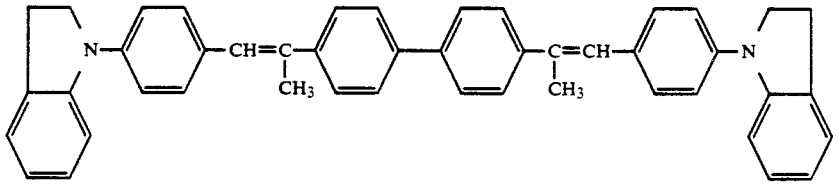

-continued
(35)
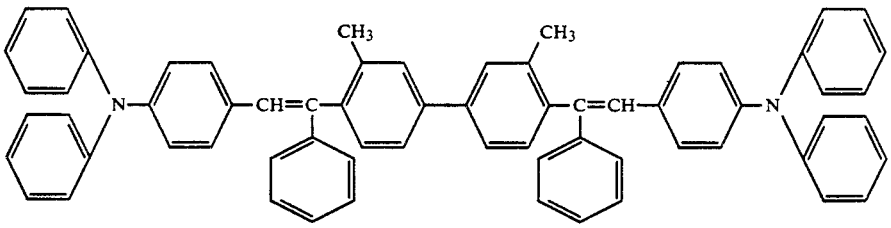
(36)
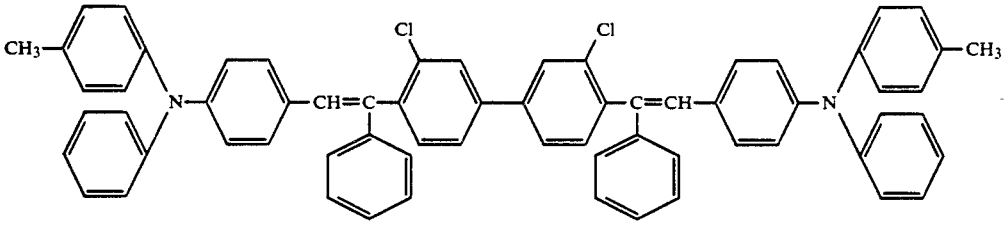
(37)
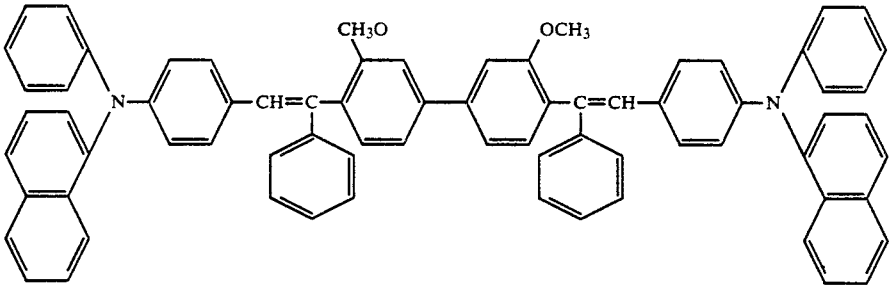
(38)
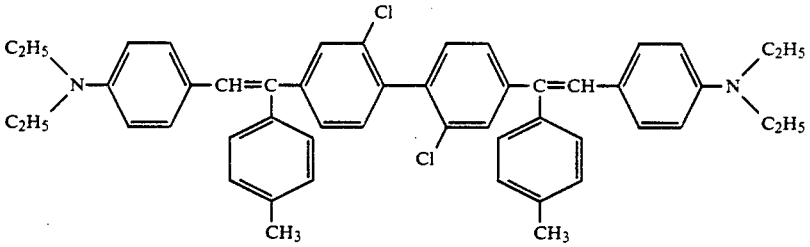
(39)
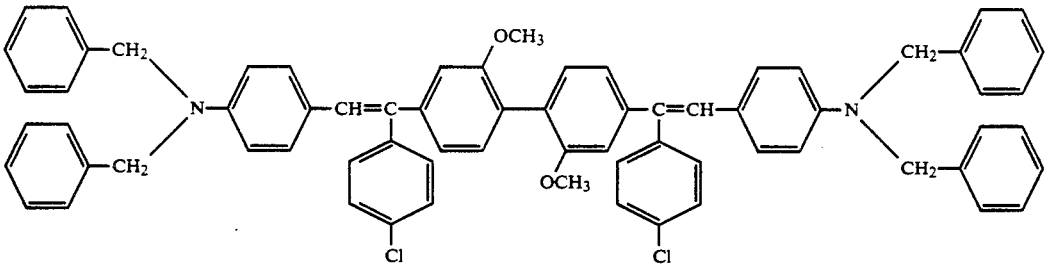
(40)
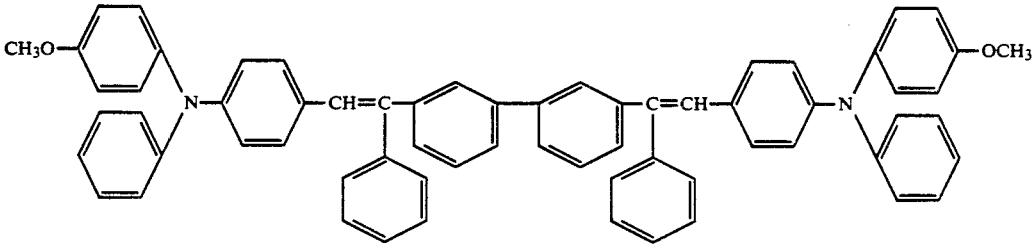

-continued (41)

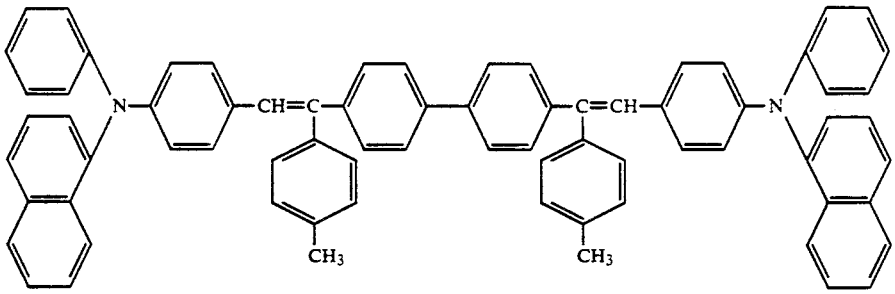

(42)

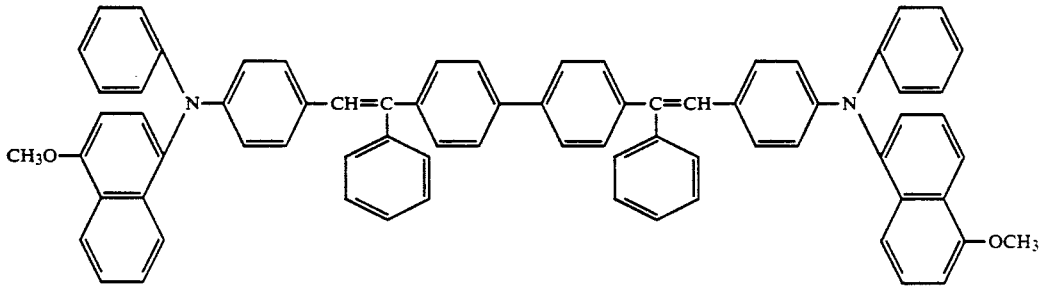

(43)

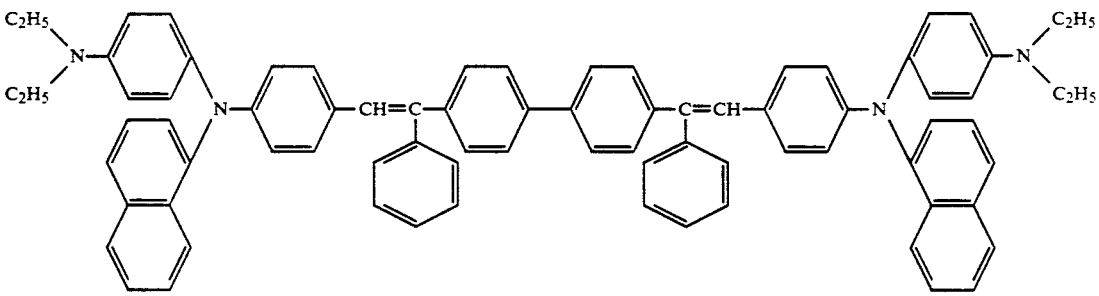

(44)

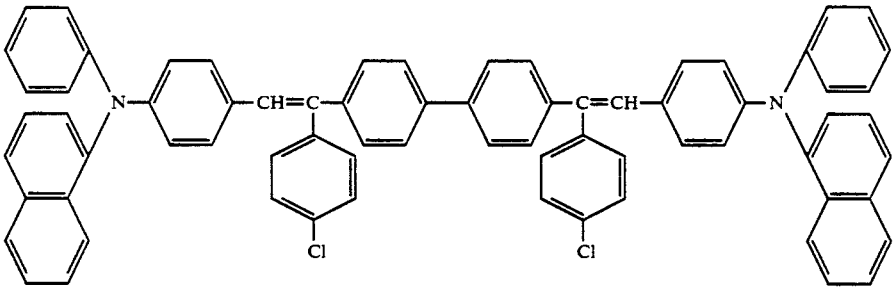

The above-listed compounds may be used either on their own or as admixtures.

The stilbene compounds represented by the general formula (I) can be readily synthesized by any known methods. According one method, a dialkylphosphoric acid compound represented by the following general formula (II):

(II)

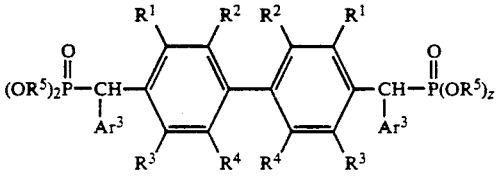

(where $Ar^3$, $R^1$–$R^4$ have the same meanings as defined above; and $R^5$ is a lower alkyl group) is reacted with an aldehyde compound represented by the following general formula (III):

(III)

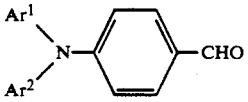

(where $Ar^1$ and $Ar^2$ have the same meanings as defined above) in the presence of a basic catalyst at 0°–200° C., preferably 5°–150° C. Suitable basic catalysts that can be used include sodium hydride, sodium amide, and alcoholates such as sodium methylate, sodium ethylate and potassium-t-butoxide. Suitable reaction solvents include methanol, ethanol, isopropanol, 1,2-dimethoxyethane, toluene, xylene, dioxane, tetrahydrofuran, dimethyl sulfoxide and N,N-dimethylformamide.

The dialkylphosphoric acid compound of the general formula (II) can be synthesized by the following method:

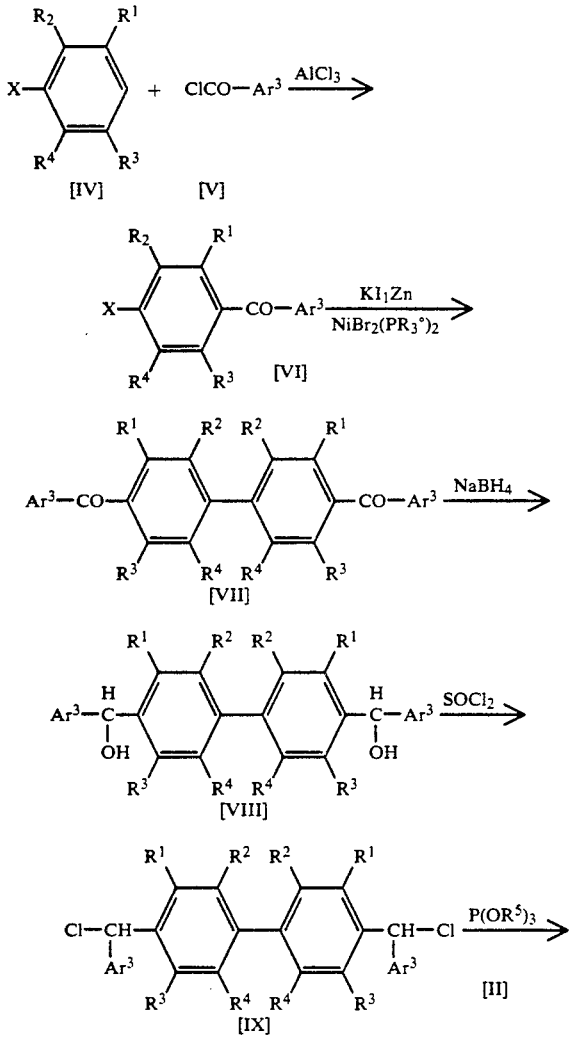

(where $R^1$–$R^5$ and $Ar^3$ are the same as defined above; x is a halogen atom such as bromine or iodine; $R^6$ is a lower alkyl group).

First, the acid chloride (IV) and the halogenated benzene derivative (V) are subjected to the Friedel-crafts reaction in the presence of aluminum chloride to obtain the ketone compound (VI). Then, in accordance with the method of K. Takagi et al. [Bull. Chem. Sec. Japan, 22, 1887–1890 (1984)], the Ullmann reaction is performed in the presence of a Ni catalyst to obtain the biphenyl compound (VII). The resulting biphenyl compound is reduced with sodium borohydride to obtain the compound (VIII), which is converted to a chloride form (IX) with thionyl chloride and thereafter treated with $P(OR^5)_3$ to obtain the dialkylphosphoric acid compound (II).

SYNTHESIS OF COMPOUND (1)

Potassium-t-butoxide (2.5 g) is dispersed and dissolved in N, N-di-methylformamide (50 ml) at room temperature in a nitrogen atmosphere. To the solution, a mixture of 4,4'-di(diethyl diphenylmethyl-phosphonate) (11.5 g) and 4-formyltriphenylamine (2.7 g) dissolved in N,N-dimethylformamide (50 ml) is added dropwise over a period of ca. 10 min. Thereafter, the mixture is stirred at room temperature for 3 h. The reaction solution is poured into water (1 L) and subjected to extraction with toluene (500 ml). The organic layer is washed with water and the solvent is removed. By recrystallization with toluene-ethanol, the end compound is obtained in an amount of 10.8 g (yield=63.9%).

By FD-mass spectrometry, the parent ion peak ($M^+$) of the end compound is detected as 844 ($C_{64}H_{48}N_2$).

Figure 3:
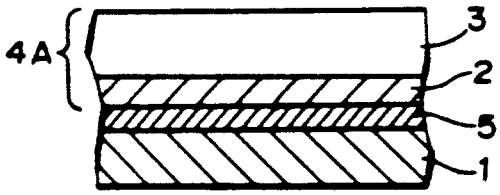
Figure 4:
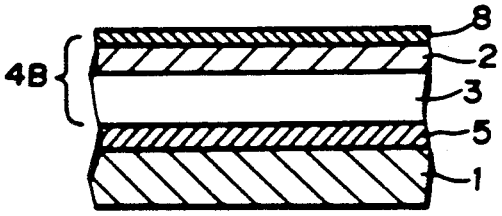
Figure 5:
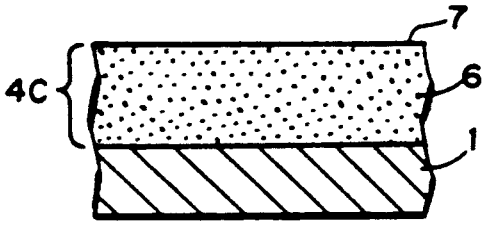
Figure 6:
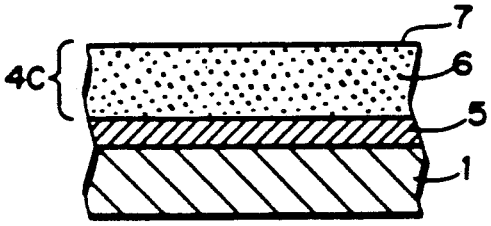

Various structural forms are known with respect to electrophotographic photoreceptors and any of them can be adopted by the photoreceptor of the present invention. Common structural forms are shown in FIGS. 1–6. The photoreceptor shown in FIG. 1 comprises an electroconductive base 1 which has formed thereon a light-sensitive layer 4A comprising a carrier generation layer 2 that contains a carrier generation material as a chief component and which is overlaid with a carrier transport layer 3 that contains a carrier transport material based. The order of superposition of the carrier generation layer 2 and the carrier transport layer 3 may be reversed as shown by 4B in FIG. 2. As shown in FIGS. 3 and 4, an intermediate layer 5 may be disposed between the light-sensitive layer 4A or 4B and the conductive base 1. By adopting such superposed layers in the light-sensitive layer 4A or 4B, a photoreceptor having most desirable electrophotographic characteristics can be obtained. Other modifications of the photoreceptor of the present invention are shown in FIGS. 5 and 6, in the case shown in FIG. 5, a light-sensitive layer 4C having a carrier generation serial 7 dispersed in a layer 6 that is based on a carrier transport material is formed directly on the conductive base 1 alternatively, an intermediate layer 5 may be provided between the light-sensitive layer 4C and the conductive base 1 as shown in FIG. 6. If necessary, a protective layer 8 may be formed as the outermost layer as shown in FIG. 4.

The following compounds may be used as carrier generation materials in the light-sensitive layer, the carrier generation layer, etc:

(1) azo dyes such as monoazo dyes, disazo dyes and trisazo dyes;
(2) perylene dyes such as perylenic acid anhydride and perylenic acid imide;
(3) indigo dyes such as indigo and thioindigo;
(4) polycyclic quinones such as anthraquinone, pyrenequinone and flavanthrone;
(5) quinacridone dyes;
(6) bisbenzimidazole dyes;
(7) indanthrone dyes;
(8) squarylium dyes;
(9) cyanine dyes;
(10) azulenium dyes;
(11) triphenylmethane dyes;
(12) amorphous silicon;
(13) phthalocyanine dyes such as metal phthalocyanine and metal free phthalocyanine;
(14) slenium, selenium-tellurium, and selenium-arsenic;
(15) CdS, CdSe and CaSe;
(16) pyrylium salt dyes and thiapyrylium salt dyes.

These dyes may be used either on their own or as admixtures. Preferred examples are those listed under (1), (4), (8) and (13).

Particularly preferred dyes are those represented by the following general formulas (X)-(XII):

(X):

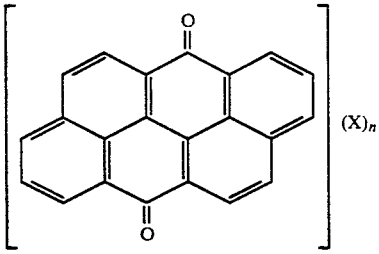

(XI):

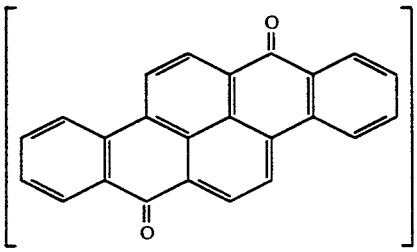

(XII):

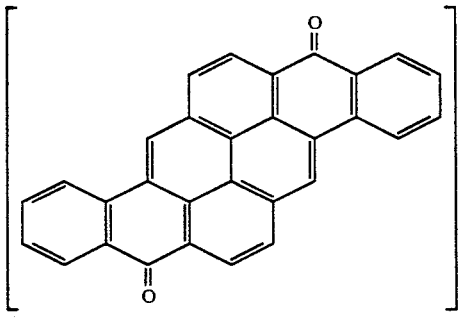

(where X is a halogen atom, a nitro group, a cyano group, an acyl group or a carboxyl group; n is an integer of 0-4; and m is an integer of 0-6).

The stilbene derivatives used in the present invention have no film forming capability by themselves and hence are combined with various binders to form a light-sensitive layer.

While any binders may be used in the present invention, it is preferred to use hydrophobic, high-dielectric constant, electrically insulating film-forming high-molecular weight polymers. Such high-molecular weight polymers include but are not limited to the following;

(P-1) polycarbonates;
(P-2) polyesters;
(P-3) methacrylic resins;
(P-4) acrylic resins;
(P-5) polyvinyl chloride;
(P-6) polyvinylidene chloride;
(P-7) polystyrene;
(P-8) polyvinyl acetate;
(P-9) styrene-butadiene copolymer;
(P-10) vinylidene chloride-acrylonitrile copolymer;
(P-11) vinyl chloride-vinyl acetate copolymer;
(P-12) vinyl-chloride-vinyl acetate-maleic anhydride compolymer;
(P-13) silicone resins;
(P-14) silicone-alkyd resins;
(P-15) phenol-formaldohyde resin;
(P-16) styrene-alkyd resins;
(P-17) poly-N-vinylcarbazole;
(P-18) polyvinylbutyral; and
(P-19) polyvinylformal.

These binder resins may be used either on their own or as admixtures.

Solvents that can be used to form the carrier transport layer of the photoreceptor of the present invention include; N,N-dimethylformamide, acetone, methyl ethyl ketone, cyclohexanone, benzene, toluene, xylene, chloroform, 1,2-dichloroethane, 1,2-dichloropropane, 1,1,2-trichloroethane, 1,1,1-trichlorothane, trichloroethylene, tetrachloroethane, dichloromethane, tetrahydrofuran, dioxane, methanol, ethanol, isopropanol, ethyl acetate, butyl acetate, dimethyl sulfoxide and methyl cellosolve. These solvents may be used either on their own or as admixtures.

If the light-sensitive layer in the photoreceptor of the present invention is of a multilayer, the weight ratio of the binder to carrier generation material to carrier transport material in the carrier generation layer is preferably in the range of (0-100):(1-500):(0-500). If the content of the carrier generation material is smaller than the lower limit shown above, photosensitivity will decrease where as residual potential will increase. If the content of the carrier generation material is greater than the upper limit shown above, dark decay and acceptance potential will decrease.

The content of the carrier transport material is preferably in the range of 20-200 parts, more preferably 30-150 parts, by weight per 100 parts by weight of the binder resin in the carrier transport layer.

The carrier generation layer thus formed preferably has a thickness of 0.01-10 μm, with the range of 0.1-5 μm being particularly preferred.

The carrier transport layer preferably has a thickness of 5-50 μm, with the range or 5-30 μm being particularly preferred.

If the light-sensitive layer in the photoreceptor of the present invention is of a single-layered, functionally separated structure, the weight ratio of the binder to carrier generation material to carrier transport material in the light-sensitive layer is preferably in the range of (0-100):(1-500):(1-500). The light-sensitive layer preferably has a thickness of 5-50 μm, with the range of 5-30 μm being particularly preferred.

The conductive base support to be used in the photoreceptor of the present invention may be a metal (inclusive of alloys) plate, a metal drum or a thin conductive layer that in made of a conductive polymer, a conductive compound such as indium oxide or a metal (inclusive of alloys) such as aluminum, palladium or gold and which is coated, vapor-deposited, laminated or otherwise formed on a substrate such as paper or a plastic film in order to make them electrically conductive. Intermediate layers such as an adhesive layer or a barrier layer may be made of any of the high-molecular weight polymers cited above as hinder resins. Also usable are organic high-molecular weight materials (e.g. polyvinyl alcohol, ethyl cellulose and carboxymethyl cellulose) and aluminum oxide.

For preventing ozone-induced deterioration, antioxidants may be incorporated in the light-sensitive layer of the photoreceptor of the present invention. The following are typical but by no means limiting examples of antioxidante that can be used in the present invention:

Group (I): hindered phenols;

dibutylhydroxytoluene, 2,2'-methylenebis(6-t-butyl-4-methylphenol), 4,4'-butylidenebis (6-t-butyl-3-methyl-phenol), 4,4'-thiobis (6-t-butyl-3-methylphenol), 2,2'-butylidenebis(6-t-butyl-4-methylphenol), α-tocopherol, β-tocopherol, 2,2,4-trimethyl-6-hydroxy-7-t-butylchroman, pentaerythrityl tetraquis [3-(3,5-di-t-butyl-4-hydroxyphenyl)propionate], 2,2'-thiodiethylenebis [3-(3,5-di-t-butyl-4-hydroxyphenyl)propionate], 1,6-hexanediolbis[3-(3,5-di-t-butyl-4-hydroxyphenyl)propionate], butylhydroxyanisole, dibutylhydroxyanisole, 1-[2-{(3,5-di-butyl-4-hydroxyphenyl)propionyloxy}ethyl]-4-[3-(3,5-di-butyl-4-hydroxyphenyl)propionyl-oxy]-2,2,6,6-tetramethylpiperidyl;

Group (II): paraphenylenediamines;

N-phenyl-N'-isopropyl-p-phenylenediamine, N,N'-di-sec-butyl-p-phenylenediamine, N-phenyl-N-sec-butyl-p-phenlenedimamine, N,N'-diisopropyl-p-phenylenediamine, and N,N' dimethyl N,N'-di-butyl-p-phenylenediamine;

Group (III), hydroquinones:

2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone;

Group (IV): organo sulfur compounds;

dilauryl-3,3'-thiodipropionate, distearyl-3,3'-thiodipropionate and ditetradecyl-3,3'-thiodipropionate; and Group (V): organophosphorus compounds;

triphenylphosphine, tri(nonylphenyl)phosphine, tri(dinonyl-phenyl)phosphine, tricresylphosphine, and tri(2,4-dibutylphenoxy)-phosphine.

Other compounds that can be used as antioxidants include hindered amines and those which have both a hindered amine structure and a hindered phenol structure. Specific examples of such compounds are described in Japanese Patent Application Nos. 61-162866, 61-188976, 61-195878, 61-157644, 61-195879, 61-162867, 61-204469, 61-217493, 61-217492 and 61-221541.

The compounds described above are known as antioxidants for use in rubbers, plastics, fats and oils, etc. and are commercially available on the market.

The antioxidants described above may be incorporated in any of the carrier generation layer, carrier transport layer and protective layer but preferably in the carrier transport layer. If they are to be added to the carrier transport layer, they are used in amounts ranging from 0.1 to 100 parts by weight, preferably from 1 to 50 parts by weight, more preferably from 5 to 25 parts by weight, per 100 parts by weight of the carrier transport material.

In order to improve sensitivity or reduce residual potential or fatigue due to cyclic use, the carrier generation layer of the photoreceptor of the present invention may contain one or more electron-accepting materials. Useful electron-accepting materials are selected from among the following compounds having high electron affinity; succinic anhydride, maleic anhydride, dibromosuccinic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl choride, quinone chlorimide, chloranil, bromanil, dichlorodicyano-p-benzoquinone, anthraquinone, dinitroanthraquinone, 2,7-dinitrofluorenone, 2,4,7-trinitrofluorenone, 2,4,5,7-tetranitrofluorenone, 9-fluorenylidene(malonodinitrile), polynitro-9-fluorenylidens-(malonodinitrile), picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, and mellitic acid.

These electron-accepting materials are used in such amounts that the weight ratio of carrier generation material to electron-accepting material is in the range of from 100:0.01 to 100:200, preferably from 100:0.1 to 100:100.

The electron-accepting materials may also be incorporated in the carrier transport layer. In this case, they are used in such amounts that the weight ratio of carrier transport material to electron-accepting material is in the range of from 100:0.01 to 100:100, preferably from 100:0.1 to 100:50.

If necessary, the photoreceptor of the present invention may contain additives such as an ultraviolet absorber in order to protect the light-sensitive layer. It may also contain dyes capable of color sensitivity correction.

The photoreceptor of the present invention is applicable not only to electrophotographic copiers but also to other apparatus such as printers using a laser, CRT or LED as a light source.

The following examples are provided for the purpose of further illustrating the present invention but are in no way to be taken as limiting.

EXAMPLE 1

An electroconductive base support having aluminum evaporated on a polyester film was coated with an intermediate layer 0.05 μm thick that was made of a vinyl chloride-vinyl acetate-maleic acid copolymer ("ES-lec MF-10" of Sekisui Chemical Co., Ltd.) In the next step, 1 g of dibromoanthanthrone ("Menolite Red 2Y" of ICI Ltd.; C.I. No. 5500) was added to 30 ml of 1,2-dichloroethane and dispersed by means of a ball mill. In the resulting dispersion, 1.5 g of a polycarbonate ("Panlite L-1250" of Teijin Chemicals Ltd.) was dissolved and mixed well to prepare a coating solution, which was supplied onto the intermediate layer to form a carrier generation layer in a dry thickness of 2 μm.

Subsequently, 7 g of stilbene compound (1) and 10 g of a polycarbonate ("Z-200" of Mitsubishi Gas Chemical Co., Inc.) were dissolved in 80 ml of 1,2-dichloroethane and the resulting solution was coated onto the carrier generation layer to form a carrier transport layer in a dry thickness of 13 μm.

The characteristics of the thus fabricated photoreceptor were evaluated by the following method with a paper analyzer Model EPA-8100 of Kawaguchi Electric Works Co., Ltd. The photoreceptor was charged at a negative voltage of 6 kV for 5 sec and left in the dark for 5 sec. Thereafter, the photoreceptor was illuminated under a halogen lamp to give a light intensity of 2 lux on the surface and the initial surface potential $V_A$ and the half-decay exposure E1/2 were measured. Also measured was the residual potential $V_R$ that remained after exposure of 30 lux·sec. Similar measurements were repeated by 1,000 times. The results were as shown in Table 1.

TABLE 1

| | Initial | | | After 1,000 cycles | | |
|---|---|---|---|---|---|---|
| | (V) $-V_A$ | (lux · sec) E ½ | (V) $-V_R$ | (V) $-V_A$ | (lux · sec) E ½ | (V) $-V_R$ |
| Example 1 | 930 | 1.8 | 0 | 920 | 1.9 | 0 |

EXAMPLE 2-10

Additional photoreceptors were fabricated by repeating the procedure of Example 1 except that stilbene compound (1) was replaced by the stilbene compounds shown in Table 2. The results of measurements conducted on these samples in the same manner as in Example 1 are also shown in Table 2.

TABLE 2

| Example No. | Stilbene compound | Initial (V) $-V_A$ | Initial (lux · sec) $E\frac{1}{2}$ | Initial (V) $-V_R$ | After 1,000 cycles (V) $-V_A$ | After 1,000 cycles (lux · sec) $E\frac{1}{2}$ | After 1,000 cycles (V) $-V_R$ |
|---|---|---|---|---|---|---|---|
| 2 | 5 | 910 | 1.8 | 0 | 900 | 1.9 | 0 |
| 3 | 8 | 940 | 1.9 | 0 | 930 | 2.0 | 0 |
| 4 | 9 | 900 | 1.9 | 0 | 890 | 2.0 | 0 |
| 5 | 13 | 930 | 2.1 | 0 | 920 | 2.2 | 0 |
| 6 | 17 | 920 | 2.0 | 0 | 910 | 2.1 | 0 |
| 7 | 22 | 930 | 2.1 | 0 | 910 | 2.2 | 0 |
| 8 | 31 | 910 | 1.9 | 0 | 900 | 2.0 | 0 |
| 9 | 35 | 940 | 2.0 | 0 | 920 | 2.1 | 0 |
| 10 | 40 | 900 | 2.1 | 0 | 880 | 2.2 | 0 |

COMPARATIVE EXAMPLES 1 AND 2

Two comparative photoreceptors were fabricated as in Example 1 except that the compounds shown below were used as carrier transport materials:

COMPARATIVE EXAMPLE 1

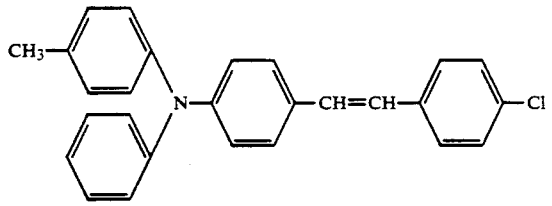

COMPARATIVE EXAMPLE 2

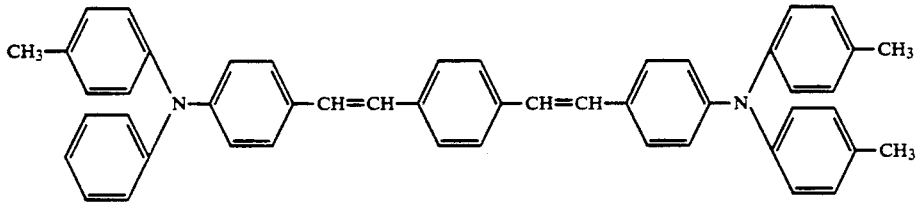

The characteristics of these comparative photoreceptors were evaluated as in Example 1 and the results were as shown in Table 3.

TABLE 3

| | Initial (V) $-V_A$ | Initial (lux · sec) $E\frac{1}{2}$ | Initial (V) $-V_R$ | After 1,000 cycles (V) $-V_A$ | After 1,000 cycles (lux · sec) $E\frac{1}{2}$ | After 1,000 cycles (V) $-V_R$ |
|---|---|---|---|---|---|---|
| Comparative Example 1 | 900 | 2.7 | 0 | 820 | 3.0 | 1.0 |
| Comparative Example 2 | 870 | 2.4 | 0 | 840 | 2.7 | 4 |

EXAMPLE 11

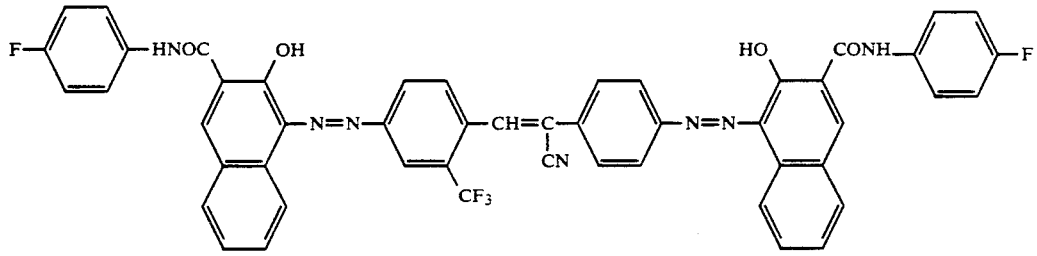

Two grams of the bisazo pigment having the structure shown above and 2 g of a polyearbonate resin "Panlite L-1250" were mixed in 100 ml of 1,2-dichloroethane and dispersed with a sand grainder for 8 h. The resulting dispersion was applied onto a conductive base support having aluminum evaporated on a polyester film. The so formed carrier generation layer had a dry thickness of 1 μm.

Using stilbene compound (1) as a carrier transport material, a carrier transport layer was formed as in Example 1. The thus fabricated photoreceptor was subjected to the same measurements as in Example 1 and the results were as shown in Table 4.

TABLE 4

| | Initial (V) $-V_A$ | Initial (lux · sec) $E\frac{1}{2}$ | Initial (V) $-V_R$ | After 1,000 cycles (V) $-V_A$ | After 1,000 cycles (lux · sec) $E\frac{1}{2}$ | After 1,000 cycles (V) $-V_R$ |
|---|---|---|---|---|---|---|
| Example 11 | 900 | 1.3 | 0 | 880 | 1.4 | 0 |

EXAMPLES 12 TO 20

Additional photoreceptors were fabricated by repeating the procedure of Example 11 except that stilbene compound (1) was replaced by the stilbene compounds shown in Table 5. The results of measurements conducted on these samples in the same manner as in Example 11 are also shown in Table 5.

TABLE 5

| Example No. | Stilbene compound | Initial (V) $-V_A$ | Initial (lux · sec) $E\frac{1}{2}$ | Initial (V) $-V_R$ | After 1,000 cycles (V) $-V_A$ | After 1,000 cycles (lux · sec) $E\frac{1}{2}$ | After 1,000 cycles (V) $-V_R$ |
|---|---|---|---|---|---|---|---|
| 12 | 5 | 880 | 1.2 | 0 | 870 | 1.3 | 0 |
| 13 | 8 | 870 | 1.3 | 0 | 860 | 1.4 | 0 |
| 14 | 9 | 890 | 1.3 | 0 | 880 | 1.4 | 0 |
| 15 | 13 | 870 | 1.2 | 0 | 860 | 1.3 | 0 |
| 16 | 17 | 900 | 1.2 | 0 | 890 | 1.3 | 0 |
| 17 | 22 | 860 | 1.4 | 0 | 840 | 1.6 | 0 |
| 18 | 31 | 880 | 1.3 | 0 | 860 | 1.4 | 0 |
| 19 | 35 | 890 | 1.4 | 0 | 870 | 1.5 | 0 |
| 20 | 40 | 870 | 1.3 | 0 | 860 | 1.4 | 0 |

COMPARATIVE EXAMPLES 3 AND 4

Two additional comparative photoreceptors were fabricated as in Example 11 except that the compounds shown below were used as carrier transport materials:

COMPARATIVE EXAMPLE 3

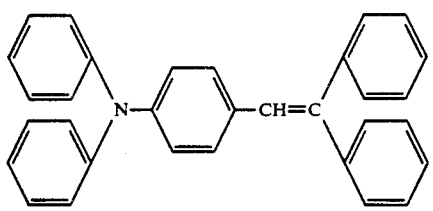

COMPARATIVE EXAMPLE 4

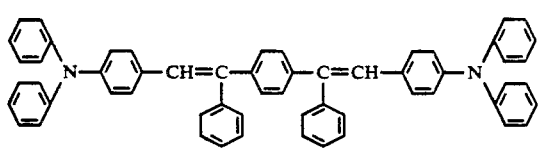

The characteristics of these comparative photoreceptors were evaluated as in Example 1 and the results were as shown in Table 6.

TABLE 6

| | Initial (V) $-V_A$ | Initial (lux · sec) $E\frac{1}{2}$ | Initial (V) $-V_R$ | After 1,000 cycles (V) $-V_A$ | After 1,000 cycles (lux · sec) $E\frac{1}{2}$ | After 1,000 cycles (V) $-V_R$ |
|---|---|---|---|---|---|---|
| Comparative Example 3 | 900 | 1.7 | 0 | 840 | 2.0 | 5 |
| Comparative Example 4 | 860 | 1.9 | 0 | 790 | 2.4 | 8 |

EXAMPLE 21

An electroconductive base support of a 100-μm thick, which has aluminum evaporated on a polyethylene terephthalate film was coated with a subbing layer ca. 0.2 μm thick that was made of a p-hydroxyetyrene polymer ("Maruzen Resin M" of Maruzen Petrochemical Co., Ltd.)

In the next step, 0.5 g of a polycarbonate resin ("Panlite L-1250" of Teijin Chemicals Ltd.), 1 g of β-type copper phthalocyanine and 100 ml of 1,2-dichloroethane were mixed with a sand mill for 10 h to prepare a dispersion. The dispersion was wire-bar coated onto the subbing layer and dried at 100° C. for 10 min to form a carrier generation layer having a thickness of ca. 0.2 μm.

Subsequently, 12 g of a carrier transport material [stilbene compound (1)] and 15 g of an acrylic resin ("Dinalol BR-80" of Mitsubishi Rayon Co., Ltd.) were dissolved in 100 ml of 1,2-di-choroethane. The resulting solution was coated with a doctor blade onto the carrier generation layer and dried at 90° C. for 1 h to form a carrier transport layer in a thickness of ca. 20 μm.

The photoreceptor thus fabricated was set in a copier adapted from "U-Bix 1550 MR" (Konica Corp.) equipped with a laser (780±1 nm; output power, 1 mW) an a light source and the surface potential of the photoreceptor was measured with the grid voltage adjusted in such a way the photoreceptor was negatively charged at 600 volts. The results of measurements were as shown in Table 7.

TABLE 7

| | $-V_H$ (V) | $-V_L$ (V) |
|---|---|---|
| Example 21 | 600 | 110 |

$V_H$: surface potential in the unexposed area;
$V_L$: surface potential in the exposed area.

COMPARATIVE EXAMPLE 5

An additional comparative photoreceptor was fabricated as in Example 21 except that the compound shown below was use as a carrier transport material:

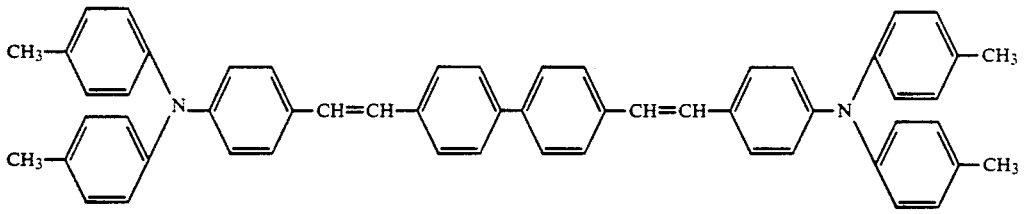

The characteristics of this comparative photoreceptor were evaluated as in Example 1 and the results were as shown in Table 8.

TABLE 8

| | $-V_M$ (V) | $-V_L$ (V) |
|---|---|---|
| Comparative Example 5 | 600 | 170 |

As the results of Example 21 and Comparative Example 5 show, the photoreceptor of the present invention had adequate sensitivity to the semiconductor laser used as a light source.

With the overall results of the examples and comparative examples taken into consideration, one can see that the photoreceptors of the present invention are superior to the comparative samples in terms of sensitivity and endurance.

What is claimed is:

1. A photoreceptor having at least a light-sensitive layer, which photoreceptor contains a compound represented by the following general formula (I):

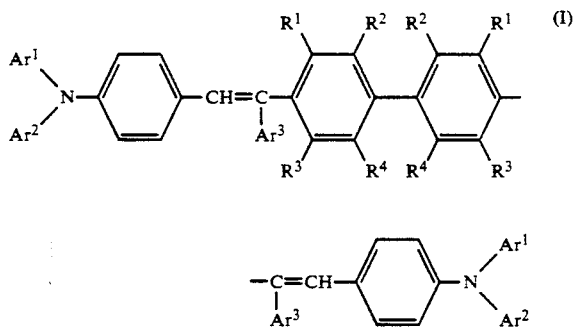

(I)

where $Ar^1$, $Ar^2$ and $Ar^3$ each represents a substituted or unsubstituted alkyl group, a substituted or unsubstituted aryl group or a substituted or unsubstituted heterocyclic group, provided that $Ar^1$ and $Ar^2$ may form a ring together with the nitrogen atom to which they are bound; $R^1$, $R^2$, $R^3$ and $R^4$ each represents a hydrogen atom, a halogen atom, an alkoxy group, or a substituted or unsubstituted alkyl group.

2. A photoreceptor according to claim 1 wherein said light-sensitive layer has a multilayer structure consisting of a carrier generation layer containing a carrier generation material as a chief component and a carrier transport layer containing a carrier transport material as a chief component.

3. A photoreceptor according to claim 2 wherein said carrier transport material is contained in an amount of 20–200 parts by weight per 100 parts by weight of the binder in the carrier transport layer.

4. A photoreceptor according to claim 2 wherein said carrier transport material is contained in an amount of 30–150 parts by weight per 100 parts by weight of the binder in the carrier transport layer.

5. A photoreceptor according to claim 2 wherein the weight ratio of the binder to said carrier generation material to said carrier transport material in the carrier generation layer is within the range of (0–100):(1–500):(0–500).

6. A photoreceptor according to claim 2 wherein said carrier generation layer has a thickness of 0.01–10 μm.

7. A photoreceptor according to claim 2 wherein said carrier transport layer has a thickness of 5–50 μm.

8. A photoreceptor according to claim 1 wherein said light-sensitive layer is of a single-layered functionally separated structure having a carrier generation material dispersed in a layer containing a carrier transport material as a chief component.

9. A photoreceptor according to claim 8 wherein the weight ratio of the binder to said carrier generation material to said carrier transport material in the light-sensitive layer is within the range of (6–100):(1–500):(1–500).

10. A photoreceptor according to claim 8 wherein said light-sensitive layer has a thickness of 5–50 μm.

11. A photoreceptor according to claim 1 wherein the carrier generation material contained in said light sensitive layer is at least one member selected from the group consisting of an azo dye, a polycyclic dye, a squarylium dye, a phthalocyanino dye, a compound represented by the following general formula (X), a compound represented by the following general formula (XI), and a compound represented by the following general formula (XII):

(X):

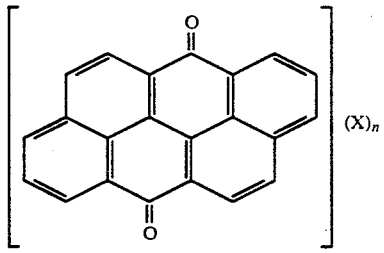

(XI):

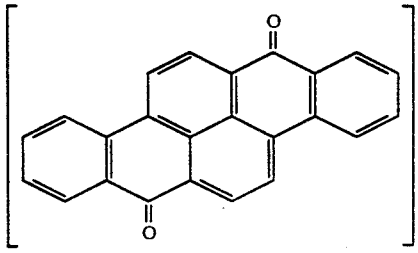

-continued (XII):

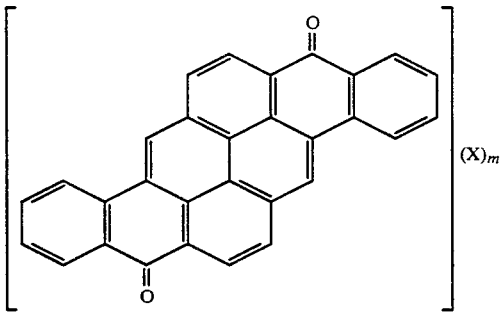

where X is a halogen atom, a nitro group, a cyano group, an acyl group or a carboxyl group; n is an integer of 0–4; and m is an integer of 0–6.

12. A photoreceptor according to claim 1 wherein the binder contained in said light-sensitive layer is at least one member selected from the group consisting of polycarbonates, polyesters, methacrylic resins, acrylic resins, polyvinyl chloride, polyvinylidene chloride, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer, silicon resins, silicone-alkyd resins, phenol-formaldehyde resin, styrene-alkyd resin, poly-N-vinylcarbazole, polyvinylbutyral and polyvinylformal.

* * * * *